US010414552B2

(12) United States Patent
Chou et al.

(10) Patent No.: US 10,414,552 B2
(45) Date of Patent: Sep. 17, 2019

(54) DRINKING CUP LID

(71) Applicants: Chen-Yu Chou, Taoyuan (TW); Chen-Yin Chou, Taoyuan (TW)

(72) Inventors: Chen-Yu Chou, Taoyuan (TW); Chen-Yin Chou, Taoyuan (TW)

( * ) Notice: Subject to any disclaimer, the term of this patent is extended or adjusted under 35 U.S.C. 154(b) by 88 days.

(21) Appl. No.: 15/706,862

(22) Filed: Sep. 18, 2017

(65) Prior Publication Data

US 2019/0084731 A1 Mar. 21, 2019

(51) Int. Cl.

*B65D 43/02* (2006.01)
*B65D 47/36* (2006.01)
*B65D 47/08* (2006.01)

(52) U.S. Cl.

CPC ..... *B65D 43/0218* (2013.01); *B65D 47/0842* (2013.01); *B65D 47/0852* (2013.01); *B65D 47/36* (2013.01); *B65D 2231/02* (2013.01); *B65D 2543/00046* (2013.01); *B65D 2543/00092* (2013.01); *B65D 2543/00518* (2013.01); *B65D 2543/00555* (2013.01); *B65D 2543/00796* (2013.01)

(58) Field of Classification Search

CPC ..... B65D 43/0218; B65D 47/0852; B65D 47/0842; B65D 47/36; B65D 2543/00555; B65D 2543/00518; B65D 2543/00796; B65D 2543/00092; B65D 2231/02; B65D 2543/00046; B65D 39/0023; B65D 39/007; B65D 39/04

USPC .... 220/253, 254.1–254.9, 256.1–259.5, 233, 220/203.13, 203.14, 787, 789, 800, 801; 215/294, 296, 299, 300, 320, 249, 375

See application file for complete search history.

(56) References Cited

U.S. PATENT DOCUMENTS 6,089,397 A * 7/2000 Van Melle ..... B65D 43/0268 220/254.7
7,954,659 B2 * 6/2011 Zuares ..... B65D 47/0804 220/254.3
8,851,325 B1 * 10/2014 Chiang ..... A47G 19/2272 220/254.3
10,016,079 B2 * 7/2018 Chiang ..... A47G 19/2272
2005/0127075 A1 * 6/2005 Smith ..... B65D 17/506 220/253

(Continued)

*Primary Examiner* — Kareen K Thomas
(74) *Attorney, Agent, or Firm* — Rosenberg, Klein & Lee

(57) ABSTRACT

A drinking cup lid, comprising: a center cover portion; a rib ring formed at the external circumferential edge of the center cover portion, the rib ring having a drinking recess, the external edge of the drinking recess being open while an insertion opening is disposed at the internal edge thereof, the bottom surface of the drinking recess being provided with a drinking opening; a vent hole formed in the center cover portion or in the rib ring; a snap ring portion formed at the external circumferential edge of the rib ring for a snap fit to the drinking cup; and a plug connected by a flexible strip in a hanging way to the external circumferential edge of the snap ring portion, the plug having a plug portion, a hand-held portion and an insert portion. Before use, the insert portion of the plug is fitted first into the insertion opening. Thereafter, the plug portion is fitted to the drinking opening. In this way, the laborious plug-and-pull problem of the conventional splash proof plug is resolved. As a result, the splash proof plug according to the invention can achieve an effort-saving plug-and-pull effect.

6 Claims, 7 Drawing Sheets

(56) References Cited

U.S. PATENT DOCUMENTS

| | | | | |
|---|---|---|---|---|
| 2006/0255043 | A1* | 11/2006 | Tedford, Jr. ..... | B65D 43/0212<br>220/375 |
| 2015/0166231 | A1* | 6/2015 | Taylor ..... | B65D 51/32<br>220/212 |
| 2016/0045045 | A1* | 2/2016 | Mazzarolo ..... | B65D 43/24<br>220/254.3 |

* cited by examiner

DRINKING CUP LID

BACKGROUND OF THE INVENTION

(a) Field of the Invention

The present invention relates to a drinking cup lid, and more particularly to a plug that prevents the beverage from splashing from the drinking recess and achieves an effort-saving plug and pull effect when fitted to the drinking recess.

(b) Description of the Related Art

U.S. Pat. No. 7,954,659 B2 discloses a lid for attachment to a disposable drinking cup. A disc of the drinking cup lid has a well and a plug fits to the well in the friction-fit/snap-fit relationship. The well is provided with a fluid opening. The plug is connected to the peripheral edge of the disc by a pair of support arms such that the plug can be inserted into the well for preventing the beverage from splashing from the well. When the plug is removed from the well, this allows drinking from the top circumferential edge of the well. At the same time, the plug stays in connection with the peripheral edge of the disc by the support arms so that the plug won't be lost.

However, the plug is secured to the well simply in the friction-fit/snap-fit relationship. In order to prevent the plug from an accidental detachment, a high strength of the friction fit must exist between the well and the plug. The high-strength friction fit ensures that it is more difficult to remove the plug from the well or to insert the plug into the well. Accordingly, the use is more laborious. In addition, the support arms are bent in a curved shape when the plug is inserted into the well. As a result, the resilience created by the pair of the support arms will produce a force for pulling the plug up from the well. Therefore, the friction fit between the well and the plug has to be increased to some extent. In this case, the plug will be more difficultly removed from the well or inserted into the well. Furthermore, the drinking at the top circumferential edge of the well can be conducted only when the drinking cup is maintained at a relatively large elevation angle so that the fluid can be flow out from the top circumferential edge of the well. Meanwhile, the user has to retract the head at a large angle in drinking, thereby causing an uncomfortable drinking position.

SUMMARY OF THE INVENTION

Therefore, a primary object of the present invention is to provide a drinking cup lid having a splash proof plug that resolves the laborious plug-and-pull problem of the conventional splash proof plug and achieves an effort-saving plug and pull effect.

A secondary object of the present invention is to provide a drinking cup lid that achieves a convenient drinking effect.

According to the invention, a drinking cup lid comprises: a center cover portion; a rib ring formed at the external circumferential edge of the center cover portion, the rib ring having a drinking recess, the external edge of the drinking recess being open while an insertion opening is disposed at the internal edge thereof, the bottom surface of the drinking recess being provided with a drinking opening; a vent hole formed in the center cover portion or in the rib ring; a snap ring portion formed at the external circumferential edge of the rib ring for a snap fit to the drinking cup; and a plug connected by a flexible strip in a hanging way to the external circumferential edge of the snap ring portion, the plug having a plug portion, a hand-held portion and an insert portion. Before use, the insert portion of the plug is fitted first into the insertion opening. Thereafter, the plug portion is fitted to the drinking opening. In this way, the laborious plug-and-pull problem of the conventional splash proof plug is resolved. As a result, the splash proof plug according to the invention can achieve an effort-saving plug-and-pull effect.

According to the invention, a positioning blind hole is formed at the center cover portion or at the rib ring. In drinking, the plug is positioned in the positioning blind hole by the plug portion.

According to the invention, the insertion opening has an upward elevation θ from inside to outside.

According to the invention, the hand-held portion of the plug is extended downward and formed at the external circumferential edge of the plug portion. The positioning blind hole is formed in an upward projecting way at the center cover portion. The center cover portion includes a recessed area corresponding to the hand-held portion. The vent hole is formed at the recessed area.

According to the invention, before use, the plug is temporarily connected by a connection point to the external circumferential edge of the snap ring portion.

According to the invention, the rib ring is formed in an upwardly tapered way.

According to the invention, the insert portion of the plug is fitted first in an inclined position into the insertion opening at the internal edge of the drinking recess before use in a splash proof position. Then, the plug portion is fitted to the drinking opening. In addition to the friction fit to the drinking opening, the plug is also exposed to the pressing force of the insertion opening. Due to the existence of the pressing force of the insertion opening, the strength of the friction fit of the plug portion of the plug to the drinking opening can be relatively reduced. It means that the plug can be pulled out of the drinking recess and fitted to it with less effort. In other words, the splash proof plug achieves an effort-saving plug and pull effect.

DETAILED DESCRIPTION OF THE PREFERRED EMBODIMENT

Figure 1:
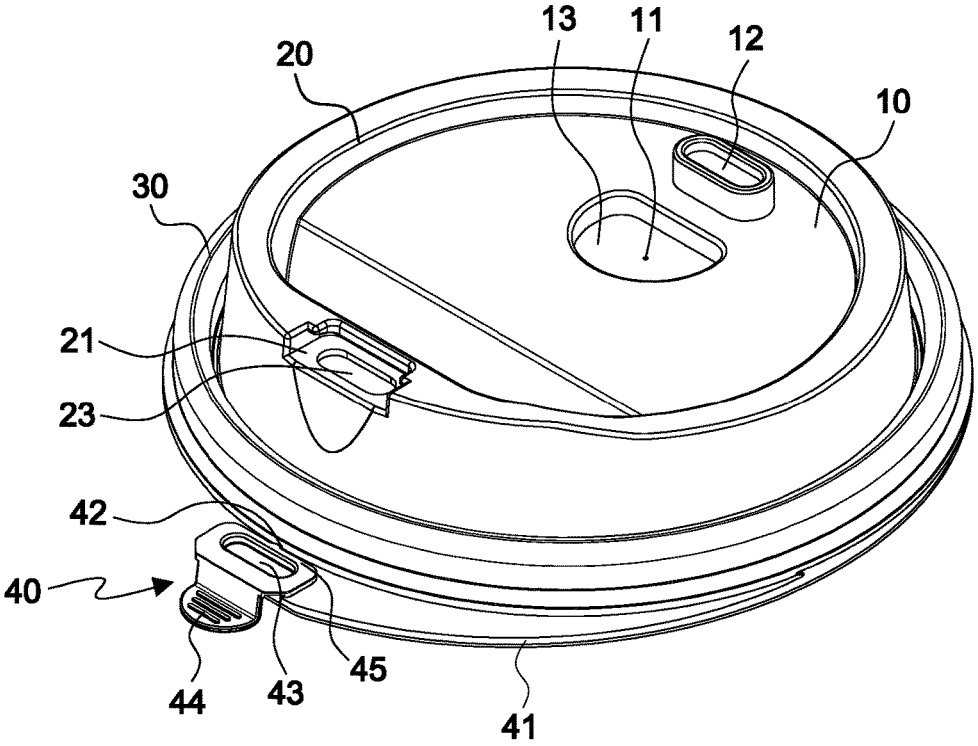
FIG. 1 is a perspective view of a drinking cup lid of the present invention.
Figure 2:
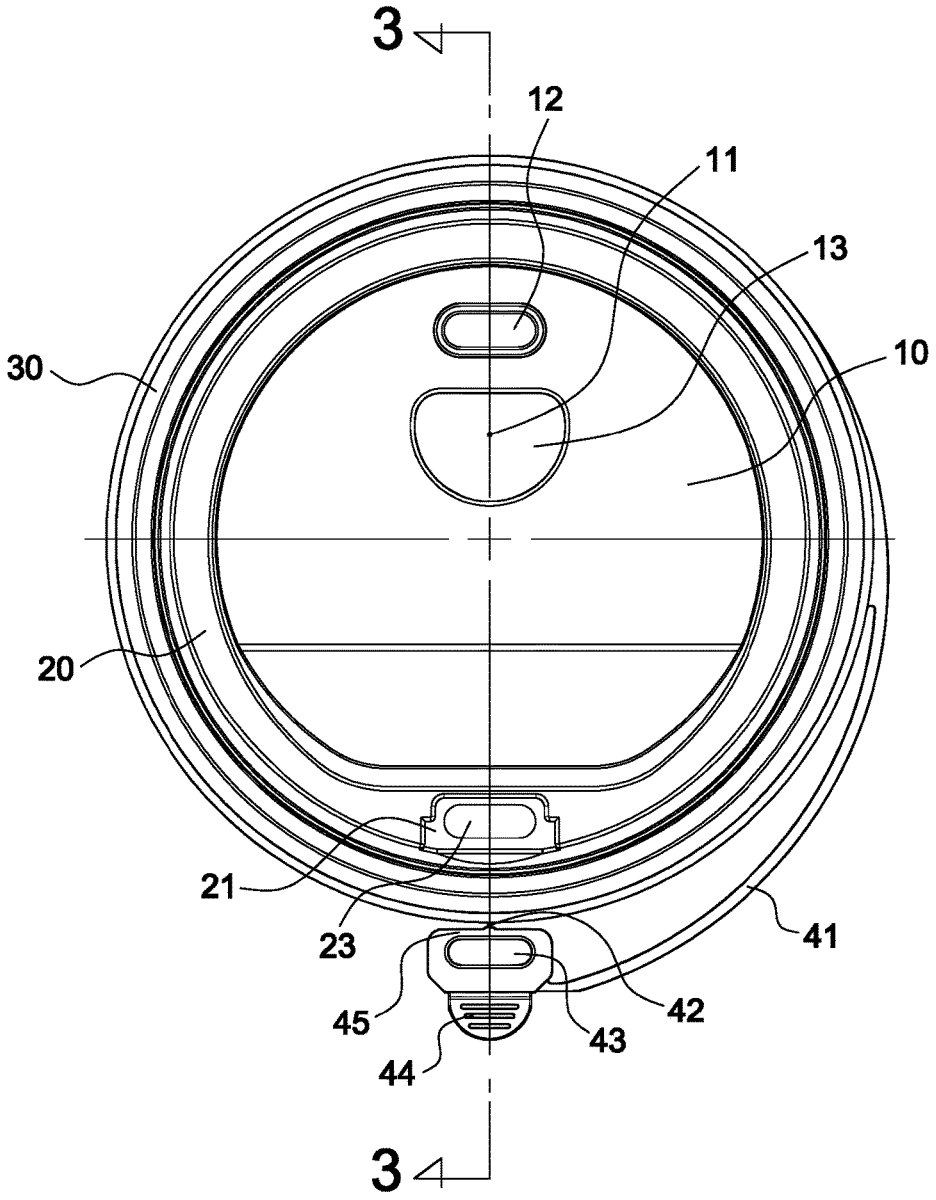
FIG. 2 is a front view of a drinking cup lid of the present invention.
Figure 3:
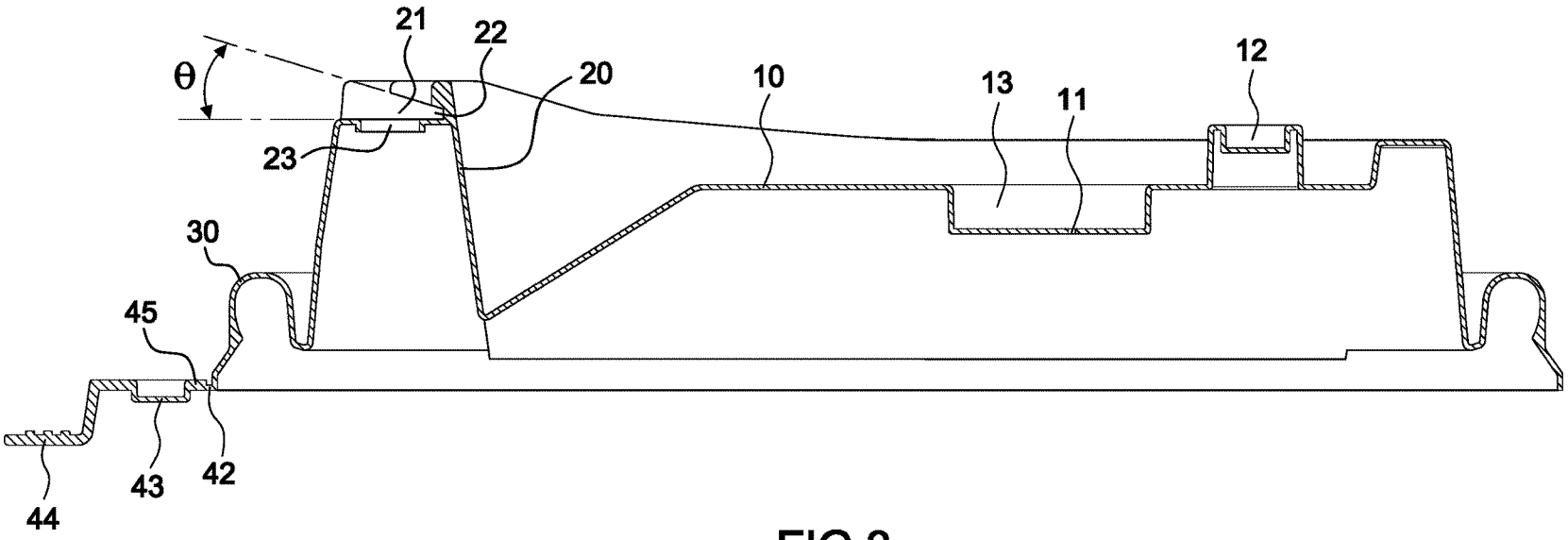
FIG. 3 is a cross-sectional view taken along the line 3-3 of FIG. 2.

With reference to FIGS. 1 through 3, a drinking cup lid has a center cover portion 10, a rib ring 20, a vent hole 11, a positioning blind hole 12, a snap ring portion 30, and a plug 40.

The rib ring 20 is formed in an upwardly tapered way at the external circumferential edge of the center cover portion 10. The rib ring 20 includes a drinking recess 21. The external edge of the drinking recess 21 is open while an insertion opening 22 is disposed at the internal edge thereof. The insertion opening 22 has an upward elevation θ from inside to outside. The bottom surface of the drinking recess 21 is provided with a drinking opening 23.

The vent hole 11 is formed in the center cover portion 10 or in the rib ring 20.

The positioning blind hole 12 is formed in an upward projecting way at the center cover portion 10 or at the rib ring 20.

The snap ring portion 30 is formed at the external circumferential edge of the rib ring 20 for a snap fit to the drinking cup.

The plug 40 is connected by a flexible strip 41 in a hanging way to the external circumferential edge of the snap ring portion 30. Moreover, the plug 40 is temporarily connected by a connection point 42 to the external circumferential edge of the snap ring portion 30. The plug 40 includes a plug portion 43, a hand-held portion 44 and an insert portion 45. The hand-held portion 44 is extended downward and formed at the external circumferential edge of the plug portion 43. The center cover portion 10 includes a recessed area 13 corresponding to the hand-held portion 44. The vent hole 11 is formed at the recessed area 13.

Figure 4:
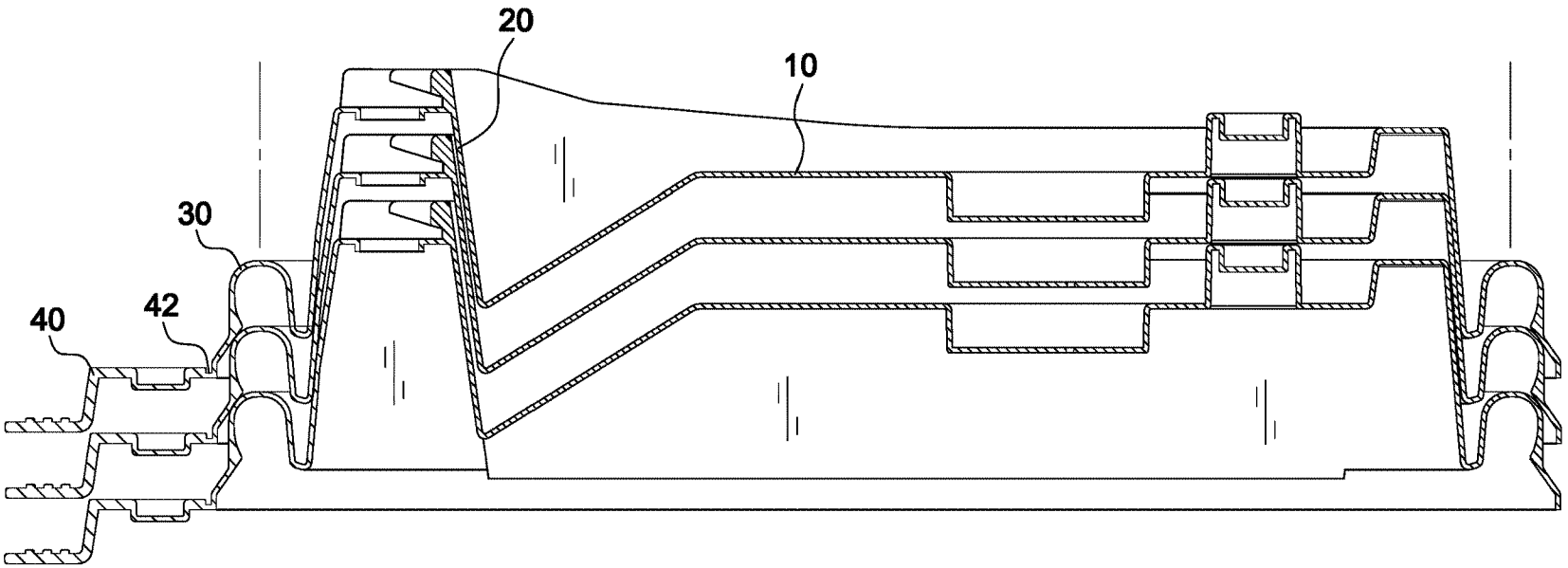
FIG. 4 is a cross-sectional view of the drinking cup lids lying one upon the other before use.
Figure 5:
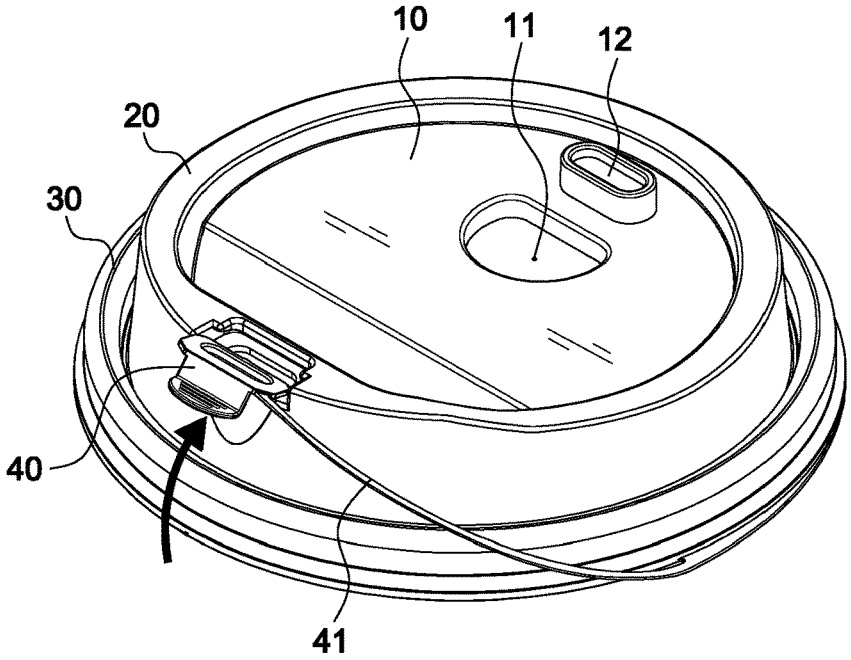
FIG. 5 is a perspective view I of a drinking cup lid of the present invention before use wherein the plug is fitted to the insertion opening.
Figure 6:
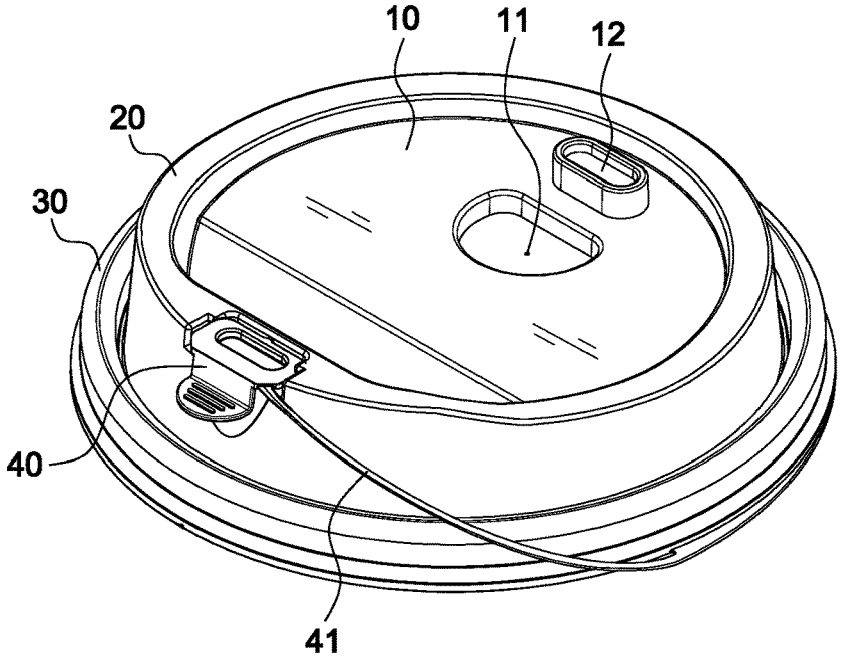
FIG. 6 is a perspective view II of a drinking cup lid of the present invention before use wherein the plug is fitted to the drinking opening.
Figure 7:
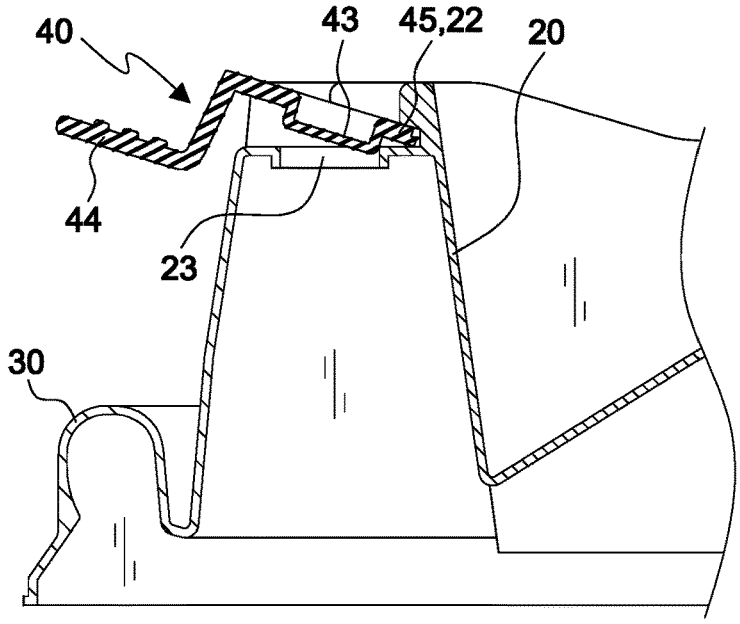
FIG. 7 is a partially cross-sectional view I of a drinking cup lid of the present invention before use wherein the plug is fitted to the insertion opening.
Figure 8:
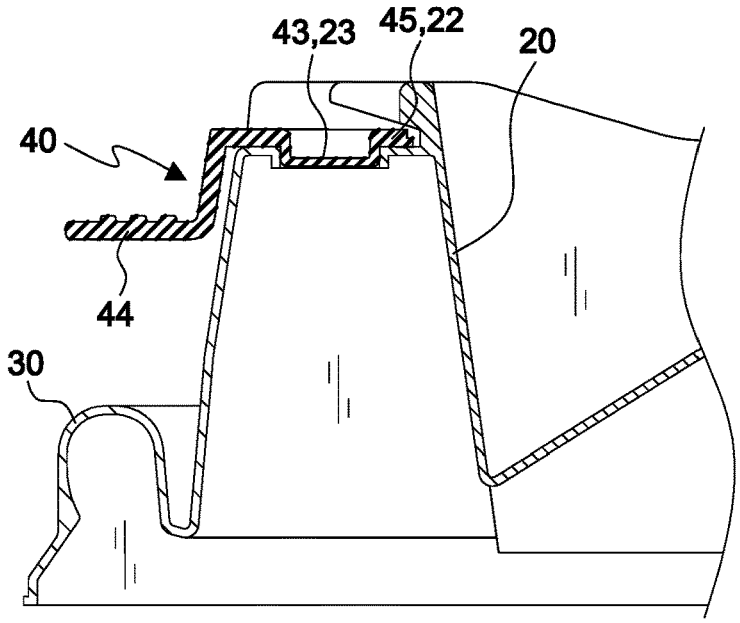
FIG. 8 is a partially cross-sectional view II of a drinking cup lid of the present invention before use wherein the plug is fitted to the drinking opening.
Figure 9:
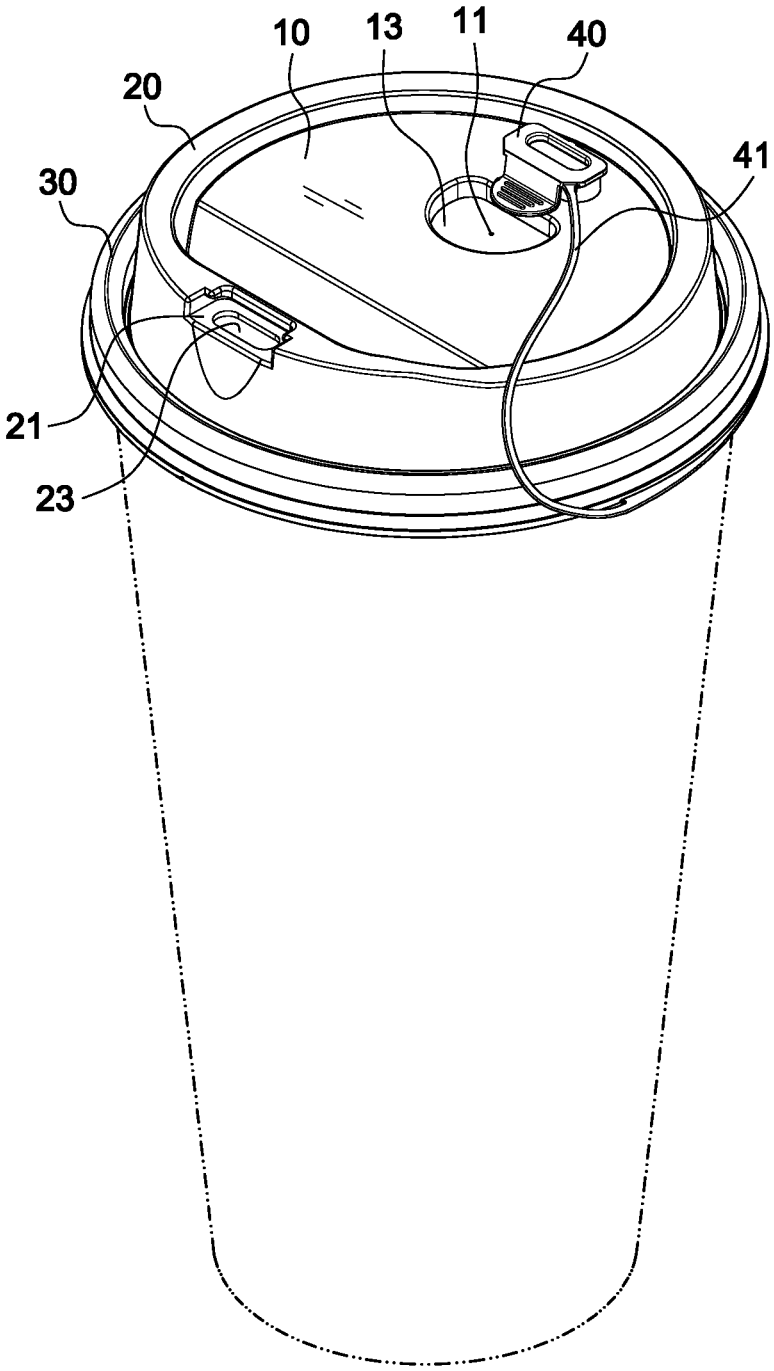
FIG. 9 is a perspective view II of a drinking cup lid of the present invention in the drinking position wherein the plug is fitted into the positioning blind hole.

As shown in FIG. 4, the drinking cup lids can be stacked for storage due to the tapered design of the rib ring 20 before use. The plug 40 is temporarily connected by a connection point 42 to the external circumferential edge of the snap ring portion 30. In use, the connection point 42 can be disconnected by a slight force to terminate the temporary connection between the plug 40 and the snap ring portion 30. In this way, the plug 40 can be connected in a hanging way by the flexible strip 41 to the external circumferential edge of the snap ring portion 30 so that the plug 40 won't be lost. As shown in FIGS. 5 through 8, the insert portion 45 of the plug 40 is fitted first in an inclined position into the insertion opening 22 at the internal edge of the drinking recess 21 before use. Then, the plug portion 43 is fitted to the drinking opening 23 such that the beverage won't splash out of the drinking opening 23. As shown in FIG. 9, the plug 40 can be pulled out of the drinking recess 21 for drinking. Thereafter, the plug 40 is the plug 40 is inserted in the positioning blind hole 12.

Therefore, the insert portion 45 of the plug 40 is fitted first in an inclined position into the insertion opening 22 at the internal edge of the drinking recess 21 before use in a splash proof position. Then, the plug portion 43 is fitted to the drinking opening 23. In addition to the friction fit to the drinking opening 23, the plug 40 is also exposed to the pressing force of the insertion opening 22. Due to the existence of the pressing force of the insertion opening 22, the strength of the friction fit of the plug portion 43 of the plug 40 to the drinking opening 23 can be relatively reduced. It means that the plug 40 can be pulled out of the drinking recess 21 and fitted to it with less effort. In other words, the splash proof plug achieves an effort-saving plug and pull effect. Moreover, the flexible strip 41 of the plug 40 won't produce a pull-up force to remove the plug 40 from the drinking recess 21. Unlike the prior art (U.S. Pat. No. 7,954,659B2) having the pull-up force, it is not required to increase the strength of the friction fit between the plug portion 43 of the plug 40 and the drinking opening 23 to offset the above-mentioned pull-up force. Accordingly, the splash proof plug achieves an effort-saving plug and pull effect. In addition, the external edge of the drinking recess 21 is open to achieve an easy flow out of the beverage from the open surface of the drinking recess 21 for a convenient drinking.

What is claimed is:

1. A drinking cup lid, comprising:

a) a center cover portion;

b) a rib ring formed at an external circumferential edge of the center cover portion, the rib ring having a drinking recess, an external edge of the drinking recess being open and an insertion opening is disposed at an internal edge thereof, a bottom surface of the drinking recess being provided with a drinking opening;

c) a vent hole formed in the center cover portion or in the rib ring;

d) a snap ring portion formed at an external circumferential edge of the rib ring for a snap fit to a drinking cup; and e) a plug connected by a flexible strip by hanging to an external circumferential edge of the snap ring portion, the plug having a plug portion, a hand-held portion, and an insert portion, wherein the insert portion of the plug is fitted first into the insertion opening before use; thereafter, the plug portion is fitted to the drinking opening.

2. The drinking cup lid of claim 1 wherein a positioning blind hole is formed at the center cover portion or at the rib ring, and wherein, in drinking, the plug is positioned in the positioning blind hole by the plug portion.

3. The drinking cup lid of claim 2 wherein the insertion opening has an upward elevation θ from inside to outside.

4. The drinking cup lid of claim 3 wherein the hand-held portion of the plug is extended downward and formed at an external circumferential edge of the plug portion, wherein the positioning blind hole is formed in an upward projecting way at the center cover portion, and wherein the center cover portion includes a recessed area corresponding to the hand-held portion, and wherein the vent hole is formed at the recessed area.

5. The drinking cup lid of claim 4 wherein, before use, the plug is temporarily connected by a connection point to the external circumferential edge of the snap ring portion.

6. The drinking cup lid of claim 5 wherein the rib ring is formed in an upwardly tapered way.

* * * * *